US007131330B2

(12) United States Patent
Gurega

(10) Patent No.: US 7,131,330 B2
(45) Date of Patent: Nov. 7, 2006

(54) SUBMERSIBLE PUMP CONTROLLER

(75) Inventor: Richard R. Gurega, Easton, CT (US)

(73) Assignee: Richal Corporation, Monroe, CT (US)

( * ) Notice: Subject to any disclaimer, the term of this patent is extended or adjusted under 35 U.S.C. 154(b) by 258 days.

(21) Appl. No.: 10/921,627

(22) Filed: Aug. 18, 2004

(65) Prior Publication Data

US 2006/0039802 A1 Feb. 23, 2006

(51) Int. Cl.
*G01F 23/30* (2006.01)
*F04B 49/04* (2006.01)

(52) U.S. Cl. ..... 73/306; 417/40; 73/305

(58) Field of Classification Search ..... 73/306, 73/290 R, 291, 305, 308, 309; 417/40
See application file for complete search history.

(56) References Cited

U.S. PATENT DOCUMENTS

| | | | | |
|---|---|---|---|---|
| 1,505,791 | A | | 8/1924 | Lenz et al. |
| 2,463,703 | A | | 3/1949 | Legler |
| 2,468,791 | A | | 5/1949 | Thomson |
| 2,910,940 | A | | 11/1959 | Colman et al. |
| 3,131,335 | A | | 4/1964 | Berglund et al. |
| 3,181,557 | A | | 5/1965 | Lannan, Jr. |
| 3,671,142 | A | | 6/1972 | Calbrese |
| 4,019,067 | A | | 4/1977 | Gladstone |
| 4,119,909 | A | | 10/1978 | DeBerry |
| 4,388,043 | A | | 6/1983 | Preiss |
| 4,437,811 | A | | 3/1984 | Iwata et al. |
| 4,466,777 | A | | 8/1984 | Kimberlin |
| 4,586,033 | A | | 4/1986 | Andrejasich |
| 4,595,341 | A | | 6/1986 | Castell-Evans |
| 4,629,398 | A | | 12/1986 | Cahalan |
| 4,678,403 | A | | 7/1987 | Rudy et al. |
| 4,715,785 | A | | 12/1987 | Gurega |
| 4,752,188 | A | | 6/1988 | Gurega |
| 4,804,936 | A | | 2/1989 | Sale |
| 5,006,044 | A | * | 4/1991 | Walker et al. ..... 417/12 |
| 5,049,037 | A | | 9/1991 | Carson et al. |
| 5,063,775 | A | * | 11/1991 | Walker et al. ..... 73/152.31 |
| 5,287,086 | A | | 2/1994 | Gibb |
| 5,324,170 | A | | 6/1994 | Anastos et al. |
| 5,463,378 | A | | 10/1995 | Gibb |
| 5,856,783 | A | | 1/1999 | Gibb |
| 6,120,614 | A | * | 9/2000 | Damron et al. ..... 134/10 |
| 6,203,281 | B1 | * | 3/2001 | Gurega ..... 417/40 |
| 6,218,948 | B1 | | 4/2001 | Dana |
| 6,368,498 | B1 | * | 4/2002 | Guilmette ..... 210/123 |
| 6,390,780 | B1 | * | 5/2002 | Batchelder et al. ..... 417/36 |
| 6,402,855 | B1 | * | 6/2002 | Damron et al. ..... 134/10 |
| 6,491,828 | B1 | * | 12/2002 | Sivavec et al. ..... 210/739 |
| 6,529,841 | B1 | | 3/2003 | Cocking et al. |
| 6,591,676 | B1 | * | 7/2003 | Marioni ..... 73/313 |

* cited by examiner

*Primary Examiner*—Daniel S. Larkin
*Assistant Examiner*—Rodney Frank
(74) *Attorney, Agent, or Firm*—Lipsitz & McAllister, LLC

(57) ABSTRACT

An apparatus for improving the service life of a submersible probe residing in a tank includes a liquid level detector adapted to detect when a liquid in the tank rises to a first level. The first level is above the probe. A controller is coupled to the liquid level detector. The controller is configured to increase at least one of a voltage and a current applied to the probe responsive to the liquid being detected at the first level. The controller is configured to reduce an electrical potential field produced by the probe responsive to the liquid falling below a second level, thereby extending the service life of the probe by reducing the accumulation of foreign matter on the probe when the pump is not activated.

22 Claims, 1 Drawing Sheet

SUBMERSIBLE PUMP CONTROLLER

BACKGROUND

The present invention relates to submersible pumps, and more particularly, to a controller for submersible pumps that can reduce the fouling of a probe coupled to the controller.

Various industrial applications require submersible pumps. For example, electric utilities commonly use water submersible pumps in transformer vaults for dewatering the vaults. If water accumulates in a transformer vault, it may short a power line causing substantial problems delivering electricity to a consumer. Accordingly, water submersible pumps are commonly placed in the transformer vault to pump out accumulated rainwater, and the like, which may seep into the vault.

Electrical transformers are normally filled with an oily fluid for lubricating and cooling the various components of the transformer. This oily fluid has a tendency to leak from the transformer housing into the vault. There is a danger to the environment if the oily fluid is pumped with the water into a waste disposal tank or sewer, as such oily fluids usually contain compounds that are harmful to the environment. Further, if the oil admixes with the water and both are pumped to a treatment disposal facility, suitable separation equipment must be provided to separate the oil from the water so that water can readily be disposed of and the oil recycled, or at least stored in a toxic safe facility. Such separation equipment is an item of considerable expense to a utility.

Hydraulic elevators are another application with similar concerns. In particular, the hydraulic oil in the hydraulic shaft tends to leak into the underground vault that houses the elevator piston. This vault may also fill with water during heavy rains due to underground seepage. It is necessary to pump the water out of the vault without pumping the hydraulic oil.

U.S. Pat. Nos. 4,715,785 and 4,752,188 disclose oil detection apparatus for use in controlling submersible pumps. In the systems described in these patents, a probe is mounted on a water submersible pump. The probe extends into any water that accumulates in the bottom of a transformer vault, enabling a conductive path to be established that is used to activate the pump. As the water level falls during pumping, oily fluids, which are immiscible in the water and rise to a level above the water, will come into contact with the probe. Since the oil is not electrically conductive, it breaks the conductive path, thereby stopping the pump. It is also known in the prior art to use a sensing circuit including a capacitance device that detects the presence of a conductive object, such as a liquid, as is taught in U.S. Pat. No. 5,287,086.

The liquids that accumulate in the vault can contain materials that contaminate the probe. The materials, such as iron, can form as deposits on the probe outer surface due to the electrical potential field on the probe. The metal ion exchange stimulated by the electrical potential field on the probe forms a fouling build-up of material. The probe is adversely effected by the fouling.

It would be advantageous to provide a method and an apparatus to ensure that only water is pumped from an industrial vault, without pumping potentially harmful substances, such as oil. It would be further advantageous to provide such a method and an apparatus in which fouling of the probe is reduced to extend the service life of the probe. The present invention provides the aforementioned and other advantages.

What is needed in the art is an apparatus in which fouling of the probe is reduced to extend the service life of the probe.

SUMMARY

In accordance with the present invention, an apparatus for improving the service life of a submersible probe residing in a tank includes a liquid level detector adapted to detect when a liquid in the tank rises to a first level. The first level is above the probe. A controller is coupled to the liquid level detector. The controller is configured to increase at least one of a voltage and a current applied to the probe responsive to the liquid being detected at the first level. The controller is configured to reduce an electrical potential field produced by the probe responsive to the liquid falling below a second level.

In an exemplary embodiment, the controller is configured to reduce the electrical potential field produced by the probe by decreasing at least one of the voltage and the current responsive to the liquid falling below the probe. The liquid level detector can be a float. A pump can be disposed in the tank and can be configured to pump the liquid from the tank responsive to the level of the liquid being detected at the first level. The pump can be in operative communication with the controller. The liquid comprises at least one of a first liquid and a second liquid, the first liquid can be removable from the tank and the second liquid can be required to remain in the tank. The second liquid floats on the first liquid. The probe can be configured to detect the presence of the first liquid and the absence of the first liquid. The controller can be configured to reduce the electrical potential field by decreasing at least one of a voltage and a current responsive to the liquid being below the second level, thereby reducing metal ion exchange proximate the probe for reducing fouling of the probe. by reducing the electrical potential field produced by the probe, the controller can prevent the accumulation of foreign matter on an outer surface of the probe resulting from the electrical potential field and subsequent metal ion exchange. The controller can be configured to reduce the electrical potential field produced by the probe subsequent a time delay and subsequent the liquid dropping below the probe. The controller can be configured to reduce the voltage or the current to the probe subsequent a time delay and subsequent the liquid dropping below the probe (i.e., a tip of the probe). In a preferred embodiment, the delay can be about one second.

An exemplary method for improving the service life of a submersible probe residing in a tank is also disclosed. The method includes detecting a liquid in the tank rising to a first level. The first level is above the probe. At least one of a voltage and a current applied to the probe can be increased responsive to the liquid being detected at the first level. The electrical potential field produced by the probe can be decreased responsive to the liquid falling below a second level. In an exemplary embodiment, the method includes a liquid level detector that is adapted to detect the first level. A controller is coupled to the liquid level detector and is configured to control the voltage and the current applied to the probe. At least one of the voltage and the current applied to the probe can be reduced responsive to the liquid dropping below the probe. The method reduces a metal ion exchange proximate the probe responsive to the liquid dropping below the probe. An accumulation of foreign matter on an outer surface of the probe resulting from the electrical potential field and subsequent metal ion exchange can be further reduced by controlling the electrical potential field produced by the probe. For example, the voltage applied to the probe can be reduced responsive to the liquid dropping below the probe. The step of decreasing the electrical potential field responsive to the liquid falling below the second level can be delayed by a predetermined time interval.

BRIEF DESCRIPTION OF THE FIGURES

Referring now to the figures, wherein like elements are numbered alike.

DETAILED DESCRIPTION

Figure 1:
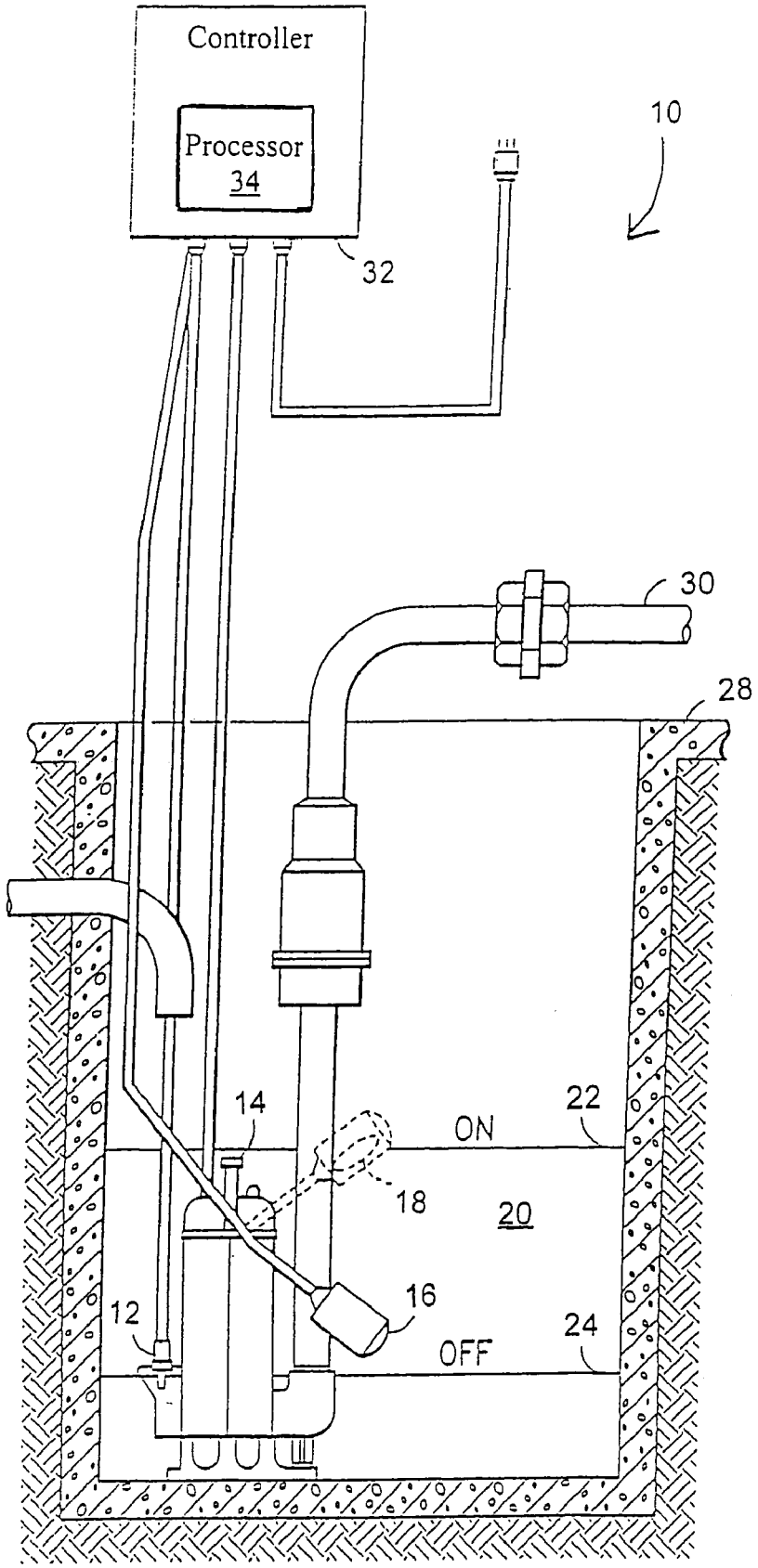
FIG. 1 is a diagram illustrating an exemplary apparatus for a submersible probe.

In accordance with the invention, a liquid (e.g., oil/water) detection apparatus is provided for use in an industrial vault and the like. During normal operation, when a first liquid, such as water, enters the vault and rises to a probe level, the presence of the liquid at the probe closes the contacts in a first switch. In an exemplary embodiment, the presence of the liquid can be detected based on the conductivity of the water shorting an electrical probe. As the water continues to rise, the water activates a liquid level detector (e.g., lifts a float) that, in combination with the probe, activates a pump, valve, motor, and the like. The pump evacuates the liquid from the vault to a level below the probe. When the liquid level falls below the probe, the liquid level detector deactivates the pump and the probe senses the absence of the liquid and indicates the liquid level. A controller coupled to the probe decreases at least one of the voltage and the current supplied to the probe responsive to the liquid level dropping below the probe. The reduced current or voltage minimizes the electrical potential field on the probe, thereby reducing fouling of the probe from metal ion exchange. When the liquid refills the vault to the level that activates the liquid level detector, the controller increases at least one of the voltage and the current supplied to the probe.

During normal operation, in which a second liquid that floats on top of the first liquid (e.g., oil on water) is present, the probe detects the presence of the second liquid and deactivates the pump. In an exemplary embodiment, the probe is insulated and does not conduct, deactivating the pump. The second liquid is a liquid that should not be pumped out of the vault without special processing. For example, oil should not be pumped out of the vault to the same location as water.

FIG. 1 illustrates an exemplary embodiment of the apparatus for improving the service life of a submersible probe. The apparatus 10 includes a probe 12 coupled proximate a pump assembly 14. The pump assembly 14 includes a liquid level detector (or float) 16. In an exemplary embodiment, the float 16 includes a float switch 18 that is actuated when the float is raised by a first liquid 20 to a first level 22. When the first liquid 20 is below the first level 22, for example, at a second level 24, the float 16 will not be raised to a point at which the float switch 18 is actuated. The float switch 18 can comprise, for example, a mercury switch, or the like, within the float 16, as shown in FIG. 1. Alternatively, a mechanical switch, Hall effect sensor, reed switch, or the like, could be adapted for activation by the liquid level detector 16. The pump assembly 14 can be submersed within a vault 28 in order to pump the first liquid 20 from the vault 28 via a pipe 30.

Probe 12 is provided in accordance with the invention to determine whether the first liquid 20 (or a second liquid) are acceptable for removal from the vault 28 (e.g., water) or unacceptable for removal from the vault 28 (e.g., oil). A controller 32 can include a processor 34 in order to distinguish between the first liquid 20 and the second liquid (not shown) at the second level 24 near the probe 12. In an exemplary embodiment, the second level 24 can be below the probe 12. If either the first liquid 20 or the second liquid is determined to be unacceptable for removal, the probe 12 and/or controller 32 shuts off the pump 14.

In normal operation, the probe 12 is energized (e.g., 5 volts direct current) and produces an electrical potential field. The electrical potential field creates a metal ion exchange proximate the probe 12. Materials present in the liquid 20 surrounding the probe 12 can react to the electrical potential field and migrate to the probe 12 and foul the probe 12. The accumulation of the foreign matter on an outer surface of the probe 12 can diminish the function of the probe 12.

The controller 32 is configured to control the voltage and/or the current supplied to the probe 12. By reducing the voltage and/or current to the probe 12, the electrical potential field can be reduced, thus minimizing the amount of fouling on the probe 12.

In an exemplary embodiment, with the vault 28 filled to the first level 22 with the first liquid 20 (or second liquid), the probe is normally active and provided with electricity at a voltage and current (e.g., 5 volts direct current). The probe 12 is configured to sense the type of liquid in the vault 28 for prevention of an improper discharge. The liquid level detector 16 detects the first liquid 20 at the first level 22 and activates the pump 14 (along with the probe 12, if inactive or in a reduced state). The pump 14 removes the first liquid 20 from the vault 28. When the first liquid 20 reaches a level below the probe 12, the controller 32 reduces the voltage from 5 volts direct current to about 15 millivolts direct current. It is contemplated that the voltage values can be varied depending on the style of probe 12 and controller 32. The liquid level detector 16 can deactivate the pump 14 responsive to the first liquid 20 level in the vault (below the probe 12). The controller 32 can increase the electricity (voltage, current) to the probe 12 responsive to the liquid level detector 16 activating as a result of the first level 22 being reached by the first liquid 20 (or second liquid).

In an exemplary embodiment, the controller 32 delays the reduction in voltage/current to the probe 12 by a predetermined amount of time. The delay by the controller ensures complete protection against unwanted discharge of the second liquid. In a preferred embodiment, the delay can be about one second. Thus, the controller 32 reduces the voltage/current to the probe subsequent a time delay of about one second after the liquid drops below the probe 12. In another exemplary embodiment, the controller 32 is responsive to the liquid dropping below the tip of the probe 12.

In operation, the controller 32 reduces the fouling on the probe 12 and extends the service life of the submersible probe in the vault 28. The rate of metal ion exchange is reduced as a result of the reduction in the voltage/current supplied to the probe 12. The reduction of the fouling by foreign material on the probe 12 extends the service life and reliability of the probe 12. There is also a reduction in maintenance required to keep the probe 12 operational.

While the present invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for improving the service life of a submersible probe residing in a tank, comprising:

a liquid level detector adapted to detect when a liquid in the tank rises to a first level, said first level being above the probe; and a controller coupled to said liquid level detector, said controller configured to increase at least one of a voltage and a current applied to the probe responsive to said liquid being detected at said first level, said controller configured to reduce an electrical potential field produced by the probe responsive to said liquid being below said second level.

2. The apparatus of claim 1 wherein said controller is configured to reduce said electrical potential field by decreasing at least one of said voltage and said current responsive to said liquid falling below the probe.

3. The apparatus of claim 1 wherein said liquid level detector is a float.

4. The apparatus of claim 1 wherein a pump is disposed in said tank and configured to pump said liquid from said tank responsive to the level of said liquid being detected at said first level.

5. The apparatus of claim 4 wherein said pump is in operative communication with said controller.

6. The apparatus of claim 5 wherein said liquid comprises at least one of a first liquid and a second liquid, said first liquid being removable from said tank and said second liquid required to remain in said tank, wherein said second liquid floats on said first liquid.

7. The apparatus of claim 6 wherein the probe is configured to detect the presence of said first liquid and the absence of said first liquid.

8. The apparatus of claim 1 wherein said controller is configured to reduce said electrical potential field by decreasing at least one of said voltage and said current responsive to said liquid falling below said second level.

9. The apparatus of claim 1 wherein said controller is configured to reduce metal ion exchange proximate the probe for reducing fouling of the probe.

10. The apparatus of claim 1 wherein said controller is configured to reduce accumulation of foreign matter on an outer surface of the probe resulting from said electrical potential field and subsequent metal ion exchange.

11. The apparatus of claim 1 wherein said controller is configured to reduce said electrical potential field subsequent a time delay and subsequent the liquid dropping below the probe.

12. The apparatus of claim 1 wherein said controller is configured to reduce one of said voltage and said current to the probe subsequent a time delay and subsequent the liquid dropping below a tip of the probe.

13. The apparatus of claim 12 wherein said delay is about one second.

14. A method for improving the service life of a submersible probe residing in a tank, comprising:

detecting a liquid in the tank rising to a first level, said first level being above the probe;

increasing at least one of a voltage and a current applied to the probe responsive to said liquid being detected at said first level; and reducing an electrical potential field produced by the probe responsive to said liquid dropping below a second level.

15. The method of claim 14 wherein a liquid level detector is adapted to detect said first level.

16. The method of claim 15 wherein a controller is coupled to said liquid level detector, said controller configured to control voltage and current applied to the probe.

17. The method of claim 14 wherein:

said step of reduce said electrical potential field comprises reducing at least one of said voltage and said current applied to the probe responsive to said liquid dropping below the probe.

18. The method of claim 14 wherein:

said step of reducing said electrical potential field comprises decreasing at least one of said voltage and said current responsive to said liquid falling below said second level.

19. The method of claim 14 comprising:

reducing a metal ion exchange proximate the probe responsive to said liquid dropping below said second level.

20. The method of claim 14 comprising:

reducing an accumulation of foreign matter on an outer surface of the probe resulting from said electrical potential field and subsequent metal ion exchange.

21. The method of claim 14 comprising:

reducing said voltage applied to the probe responsive to said liquid dropping below a tip of the probe.

22. The method of claim 14 comprising:

delaying for a predetermined time interval said reducing of said electrical potential field responsive to said liquid falling below the second level.

* * * * *